US005635677A

United States Patent [19]

Wood et al.

[11] Patent Number: 5,635,677

[45] Date of Patent: Jun. 3, 1997

[54] SERIES OF PARALLEL ELECTRICAL CONDUCTORS HELD TOGETHER BY INTERWOVEN BRAIDING

[75] Inventors: David Wood; David McNaughton; John N. Kippen; Andrea Gellan, all of Fife, United Kingdom

[73] Assignee: W. L. Gore & Associates, Inc., Newark, Del.

[21] Appl. No.: 313,213

[22] PCT Filed: Mar. 29, 1993

[86] PCT No.: PCT/GB93/00640

§ 371 Date: Nov. 25, 1994

§ 102(e) Date: Nov. 25, 1994

[87] PCT Pub. No.: WO93/20563

PCT Pub. Date: Oct. 14, 1993

[30] Foreign Application Priority Data

Apr. 3, 1992 [GB] United Kingdom ..... 9207330

[51] Int. Cl.[6] ..... H01B 7/08

[52] U.S. Cl. ..... 174/117 F; 174/117 M; 174/121 R; 174/121 SR

[58] Field of Search ..... 174/117 F, 117 R, 174/117 FF, 117 M, 121 R, 124 R, 121 SR

[56] References Cited

U.S. PATENT DOCUMENTS

| | | | |
|---|---|---|---|
| 3,495,025 | 2/1970 | Ross | 174/70 X |
| 3,582,537 | 6/1971 | Perreault | 174/117 |
| 3,654,381 | 4/1972 | Copp | 174/117 F |
| 4,418,116 | 11/1983 | Scott | 428/288 X |
| 4,463,323 | 7/1984 | Piper | 331/1 X |
| 4,956,524 | 9/1990 | Karkow | 174/117 M |
| 5,036,166 | 7/1991 | Monopoli | 174/128.1 X |
| 5,227,103 | 7/1993 | Munschiatti | 264/45.9 X |
| 5,281,475 | 1/1994 | Hollenbaugh, Jr. et al. | 428/357 X |

FOREIGN PATENT DOCUMENTS

| | | |
|---|---|---|
| 0119717 | 9/1984 | European Pat. Off. . |
| 0246115 | 11/1987 | European Pat. Off. . |
| 0256841 | 2/1988 | European Pat. Off. . |
| 614587 | 12/1948 | United Kingdom . |
| 1088768 | 10/1967 | United Kingdom . |
| 1295330 | 11/1972 | United Kingdom . |
| 9117551 | 11/1991 | WIPO . |

*Primary Examiner*—Kristine L. Kincaid
*Assistant Examiner*—Chau N. Nguyen
*Attorney, Agent, or Firm*—Gary A. Samuels, Esq.

[57] ABSTRACT

A flat cable comprises a series of parallel electrical conductors (1 to 6) each carrying a spiral-wound tape insulation layer (30). The conductors are held together by braiding formed of a plurality of tapes (10 to 22) or fibres interwoven between the conductors. The braiding is preferably of a thermoplastic material which may be heat bonded to the insulation in order to set the cable in a desired shape e.g. for a wiring loom. The insulation and braiding is preferably formed from a mixture of polytetrafluoroethylene (PTFE) and a copolymer of tetrafluoroethylene and perfluoro (propylvinylether).

8 Claims, 1 Drawing Sheet

SERIES OF PARALLEL ELECTRICAL CONDUCTORS HELD TOGETHER BY INTERWOVEN BRAIDING

TECHNICAL FIELD

The present invention relates to a flat cable construction comprising a series of parallel longitudinally extending electrical conductors arranged side-by-side.

BACKGROUND OF THE INVENTION

Flat cables are well known and are used in a variety of applications where multiple electrical connections are to be made between pieces of electrical equipment. The flat orientation of the conductors allows individual conductors to be readily identified when connections are being made or when end connectors are being attached. Conventionally, flat cables are made by extruding the insulating material onto the parallel conductors.

Conventional extrusion suffers from a number of disadvantages, particularly where high performance insulation is required, e.g. in the defence industry. Firstly, extruded flat cables are very resistant to bending in a direction parallel to the plane of the cable. This makes it difficult to form conventional flat cables into pre-configured wiring harnesses, and means that the flat cable must be routed in situ. It would be desirable to be able to produce a flat cable construction which could be bent in any direction, such as to allow the production of "drop-in" pre-configured wiring harnesses, particularly where it is difficult to route cables in situ due to restricted access or space limitations.

A second disadvantage is that such extruded insulation material does not necessarily give the best mechanical and electrical insulation properties. Also in order to safeguard the integrity of the insulation, the thickness of extruded insulation tends to be greater than, for example, that of tape-wound insulation. Insulating tapes can be processed, such as by pre-stretching in order to provide the desired mechanical and electrical properties.

It would therefore be desirable to provide a flat cable construction which mitigates some or all of these disadvantages.

U.S. Pat. No. 3 582 537 discloses a woven ribbon cable wherein a woven lattice structure holds a plurality of insulated conductor wires in a given spaced parallel relationship and has its warp and weft members bonded to each other at the intersections thereof.

W091/17551 discloses an electrical insulating composite material comprising an intimate admixture of a thermoplastic copolymer of tetrafluoroethylene and perfluoro (propyl vinyl ether) and coagulated dispersion type polytetrafluoroethylene (PTFE), or of porous expanded PTFE. Tape made from the composite material may be wrapped around a conductor and sintered to fuse the overlapping areas of the tape together.

U.S. Pat. No. 3 654 381 discloses a flat cable woven with a warp consisting solely of conductors. The weft threads are woven directly into the conductors to form the final woven cable.

SUMMARY OF THE INVENTION

The present invention provides a flat cable which comprises a series of parallel longitudinally extending electrical conductors arranged side-by-side, each conductor having an electrically insulating covering, the parallel conductors being held together by braiding comprising at least one filament interwoven between the conductors, wherein the braiding is thermoplastic and is heat-bonded to the insulating covering on the conductors.

As used herein, the term "conductor" relates to a single conductor or wire or a group of two or more conductors or wires twisted together.

Figure 2:
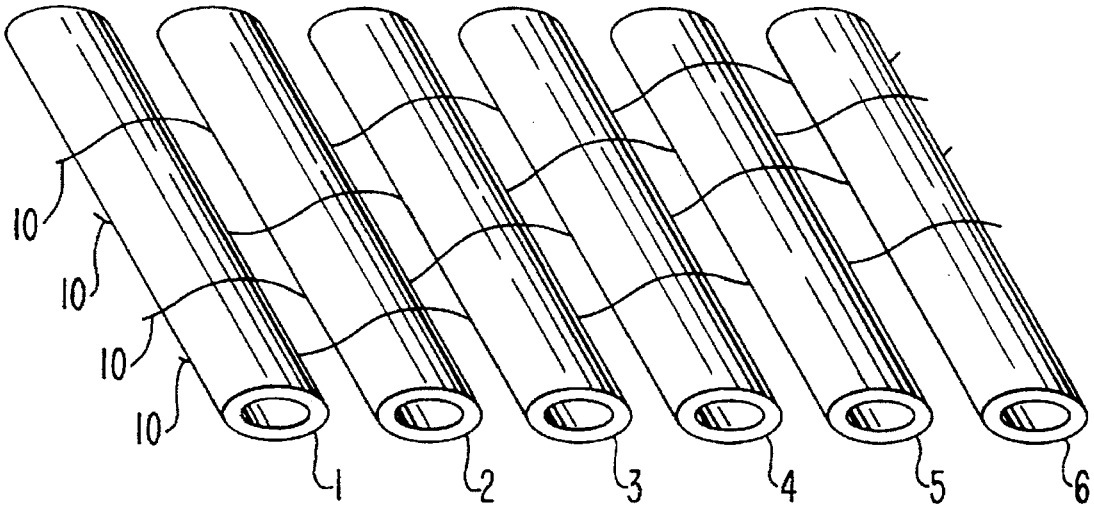
FIG. 2 depicts insulated flat parallel conductors with braiding interwoven between the conductors.

Whilst the electrically insulating covering can be extruded onto each conductor, where thin high performance insulations are required it is preferred, as shown in FIG. 2, to wrap one or more layers of an insulating tape 30 in a spiral manner around the conductor 1. Preferably, the spirally wound turns of tape overlap by up to 50% of the width of the tape in order to maintain integrity of the insulation. Typically, from 1 to 5, usually 2 or 3 layers of tape are applied. The tape is preferably formed from a mixture of polytetrafluoroethylene (PTFE) and PFA copolymer of tetrafluoroethylene (TFE) and perfluoro(propylvinylether) (PPVE) as disclosed in our international application PCT/GB91/00661. In particular, it is preferred that the insulation shall be formed of alternating layers of porous expanded material and non-porous material. Such tape wrap constructions show good abrasion and cut-through resistance and good electrical insulation properties, whilst being of relatively low thickness, and thus allowing compact cable constructions.

In an alternative embodiment, the insulating tape may be a polyester film, such as Mylar (trademark), Melenex (trademark), Hostaphan (trademark) or Milene (trademark). Such films include a polyester base film with a heat sealable thermoplastic polyester resin coating thereon which may be fused at relatively low temperatures e.g. 200°–210° C. The insulation is formed as before by tape-wrapping the conductor and heating to adhere the tape layers.

Typically, the cable comprises 2 to 12, typically 6, conductors. The conductors may comprise twisted pairs.

The parallel conductors are held together, as shown in FIG. 2, by braiding 10, comprising at least one filament interwoven between the insulated conductors insulated 1, 2, 3, 4, 5, and 6. This allows the flat cable to be bent in any direction, including the direction parallel to the plane of the cable, which imparts good flexibility. It also allows the cable to be bent into a pre-configured harness configuration. Usually, the braiding will comprise a plurality of filaments, for example 2 to 25 filaments, preferably 6 to 16 filaments. Typical braiding machines apply 13 filaments.

The filaments are preferably formed of an electrically insulating material. For some applications, the braiding is formed of a plastics material which becomes bonded to the electrically insulating covering around the conductors upon the application of heat. In particular, the braiding may be formed of the same or similar material to that used for the electrical insulation (e.g. the outer layer of tape-wrapped electrical insulation) around the conductors. Thus, when the insulating covering around the conductors is formed of a material comprising PTFE and TFE/PPVE copolymer as disclosed in the above mentioned international patent application, then the braiding is formed of the same or similar adherable material. The material may be bonded to itself by heating to a sintering temperature.

In order to provide a braiding material of high tensile strength, an expanded porous material of the type disclosed in the international patent application PCT/GB91/00661 may be used. Such porous expanded materials may have a matrix tensile strength of up to 3515 kg/cm$^2$ (50,000 pounds per square inch), and are preferably drawn down to form flat fibres. The matrix tensile strength is defined as the tensile strength divided by the porosity of the expanded porous material.

Analogously, if a polyester insulating material is used on the conductors, the braiding is preferably formed of the same material or a similar material which can be adhered thereto under the effect of heat.

In this way, the flat cable may be bent into the desired three-dimensional configuration, and then heat-set by heating to a sintering or fusing temperature.

The braiding filaments are preferably in the form of slit tapes of width 1 to 4 mm, and thickness 5 to 20 microns.

Alternatively, the braiding filaments may be in the form of fibres or round monofilaments (such as nylon or polyester).

Preferably, the filaments are interwoven by passing a filament over one conductor and under the adjacent conductor. Alternatively, groups of conductors, for example 2 to 4 conductors twisted together, may be interconnected by passing the filament over one group and under the adjacent group.

Thus, the present invention allows the production of a flat cable which can be bent in any direction in three dimensions so as to allow the pre-fabrication of a routed wiring harness. The harness configuration may then be heat-set. The flat cable construction allows both flat and round terminal connectors to be used. The flat cable is simply rolled up in a transverse direction if a circular connector terminal is to be attached. A reduced thickness of insulation may be used, leading to increased signal density and reduced cable weight.

PREFERRED EMBODIMENT

An embodiment of the present invention will now be described by way of example only in conjunction with the drawing wherein:

FIG. 2 shows a flat cable comprising six parallel insulated conductors 1 to 6 which lie side-by-side in a single plane, and which are held together by thirteen strips of braiding 10 interwoven between the conductors.

Each filament of braiding is woven over one conductor and under the adjacent conductor.

Figure 1:
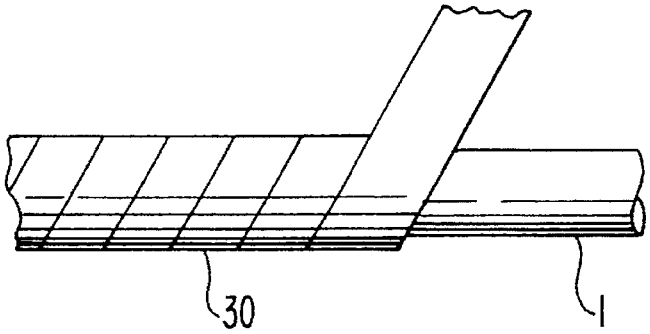
FIG. 1 depicts one conductor with spirally wound insulating tape around it.

Each conductor has an electrically insulating covering 30 around it, as shown in FIG. 1. Typically, the insulated covering comprises a first layer of a spirally wound porous expanded tape; a second layer of a non-porous spirally wound tape; and a third outer layer of a porous expanded spirally wound tape. The tapes are wound in overlapping (and possibly counter-rotatory) overlapping turns. The porous and non-porous tapes are typically formed of a composite material as disclosed in PCT/GB91/00661 (W091/17551). The non porous material typically comprises an intimate admixture of 5 to 40 wt.% of a thermoplastic copolymer of tetrafluoroethylene and perfluoro (propylvinylether) and 60 to 95 wt.% of coagulated dispersion type polytetrafluoroethylene, the composite material having been extruded and calendered to form a tape. The porous expanded composite material typically is formed of an intimate admixture of 50 to 90 wt.% of a thermoplastic copolymer of tetrafluoroethylene and perfluoro (propylvinylether) and 90 to 5 wt.% of polytetrafluoroethylene- Usually, the porous expanded material comprises 50 to 95 wt.% of copolymer.

The filaments of braiding are formed of the same porous expanded tape and have a width 2 mm and thickness 12 microns. The matrix tensile strength is 5624 to 7030 kg/cm$^2$ (80 to 100,000 pounds per square inch). The material is typically formed as Example 3 of W091/17551. The flat cable as shown in FIG. 1 may then be bent to shape in any direction. Due to the fact that the conductors are held together by braiding, the conductors may move along side each other, thereby enabling the cable to be bent in a direction parallel to the plane of the flat cable.

The cable has been formed into the desired configuration, it may be heat-set by sintering, typically by heat treating in air at 350° C. for about 1 minute.

In an alternative embodiment six twisted pairs of insulated conductors are braided into a flat cable. The conductor insulation is a heat-sealable polyester film and the braiding is formed of the same polyester material, which is heat-settable at about 200°–210° C.

Other heat-settable insulating materials may be used for the insulation and braiding, and the present invention is not limited to any particular material.

We claim:

1. A flat cable which comprises a series of parallel longitudinally extending electrical conductors arranged side-by-side, each conductor having an electrically insulating covering, the parallel conductors being held together by braiding comprising at least one filament interwoven between the conductors, wherein the braiding is thermoplastic and is heat-bonded to the insulating covering on the conductors.

2. A cable according to claim 1, wherein the electrically insulating covering is in the form of spirally wound overlapping tape.

3. A cable according to claim 2 where the insulating tape comprises two tapes; one being a polytetrafluoroethylene tape and the other being a tape of a copolymer of tetrafluoroethylene and perfluoro(propylvinyl ether).

4. A cable according to claim 3 wherein the polytetrafluoroethylene tape is porous and the copolymer tape is non-porous.

5. A cable according to claim 1 wherein the braiding filament is in the form of a tape.

6. A cable according to claim 1 wherein the braiding filament is in the form of a fibre or monofilament.

7. A cable according to claim 6 wherein the braiding filament is in the form of a polytetrafluoroethylene fiber of substantially round cross-section which has been formed from a continuous sheet of polytetrafluoroethylene which has been helically rolled and adhered to itself.

8. A cable according to claim 1 comprising a plurality of conductors and a plurality of braiding filaments, each filament passing over one conductor and under an adjacent conductor.

* * * * *